US005511852A

United States Patent [19]

Kusiak et al.

[11] Patent Number: 5,511,852

[45] Date of Patent: Apr. 30, 1996

[54] ADJUSTABLE BACKREST FOR A CHAIR

[75] Inventors: James L. Kusiak, Grand Rapids, Mich.; Rodney C. Schoenfelder, Minneapolis, Minn.

[73] Assignee: Herman Miller, Inc., Zeeland, Mich.

[21] Appl. No.: 22,138

[22] Filed: Feb. 25, 1993

[51] Int. Cl.[6] ..... A47C 3/00

[52] U.S. Cl. ..... 297/301.4; 297/353; 297/383; 297/298

[58] Field of Search ..... 297/289, 306, 297/298, 299, 300, 285, 358, 369, 375, 409, 353, 383

[56] References Cited

U.S. PATENT DOCUMENTS

| | | | |
|---|---|---|---|
| 910,357 | 1/1909 | Case . | |
| 1,927,491 | 9/1933 | Gabb | 155/157 |
| 2,271,925 | 2/1942 | Niles | 155/116 |
| 2,272,980 | 2/1942 | McCellan et al. | 297/383 X |
| 2,307,621 | 1/1943 | Dorton | 155/161 |
| 2,313,023 | 3/1943 | Ruegger | 155/116 |
| 2,369,580 | 2/1945 | Koenig | 297/383 X |
| 2,845,994 | 8/1958 | Thompson | 155/160 |
| 3,224,807 | 12/1965 | Welch et al. | 297/304 |
| 3,232,574 | 2/1966 | Ferro | 248/379 |
| 3,351,379 | 11/1967 | Street | 297/358 |
| 4,102,549 | 7/1978 | Morrison et al. | 297/383 |
| 4,372,609 | 2/1983 | Boisset | 297/362 |
| 4,406,497 | 9/1983 | Klüting | 297/366 |
| 4,429,917 | 2/1984 | Diffrient | 297/300 |
| 4,529,247 | 7/1985 | Stampf et al. | 297/301 |
| 4,536,031 | 8/1985 | Latone | 297/353 |
| 4,660,885 | 4/1987 | Suhr et al. | 297/353 |
| 4,776,633 | 10/1988 | Knoblock et al. | 297/300 |
| 4,795,212 | 1/1989 | Bailey et al. | 297/362 |
| 4,861,106 | 8/1989 | Sondergeld | 297/316 |
| 5,024,484 | 6/1991 | Buchacz | 297/306 X |

FOREIGN PATENT DOCUMENTS

| | | | |
|---|---|---|---|
| 124229 | 8/1931 | Austria | 297/306 |
| 296578A1 | 6/1988 | European Pat. Off. | A47C 1/032 |
| 539733A1 | 9/1992 | European Pat. Off. | A47C 1/032 |
| 631285 | 12/1927 | France | 297/299 |
| 3033953A1 | 5/1981 | Germany . | |
| 663526 | 12/1987 | Switzerland | 297/306 |
| 5254 | 4/1900 | United Kingdom | 297/298 |
| 23621 | 7/1915 | United Kingdom . | |
| 1346420 | 2/1974 | United Kingdom | 297/383 |
| WO87/06810 | 11/1987 | WIPO | A47C 9/02 |
| WO92/19132 | 11/1992 | WIPO | A47C 7/40 |

*Primary Examiner*—Laurie K. Cranmer

*Attorney, Agent, or Firm*—Willian Brinks Hofer Gilson & Lione

[57] ABSTRACT

An apparatus is provided for adjusting the position of a backrest relative to a chair seat. The backrest includes an elongated stem having a curved lower portion. Preferably, a spring operably engages the stem to bias it in an upward direction. A housing is adapted to slidably receive the curved portion of the stem and guide the spring. A latch mechanism is adapted to engage the stem to lock the backrest in a desired position, and an actuator member is adapted to move the latch mechanism between an engaged and disengaged position. In operation, the latch mechanism is disengaged to allow the backrest stem to move in a curvilinear path to a desired height and corresponding angular position, and reengaged to lock the backrest stem in said position.

23 Claims, 4 Drawing Sheets

ADJUSTABLE BACKREST FOR A CHAIR

BACKGROUND OF THE INVENTION

The present invention relates generally to office chairs, and more particularly, to an apparatus for adjusting the position of a backrest relative to the seat of an office chair.

Many office chairs have backrests which can be adjusted in height or angle relative to a seat. It is also desirable to adjust both the height and the angle of a backrest so that the position of the backrest corresponds to the natural position of a user's back when the user is in a desired forward or reclined position. When a user reclines or leans forward, the torso generally pivots about an axis through the hip joints of the user. Thus, it is desirable to provide a backrest with a path of movement corresponding to the pivotal movement of the user's back.

Chairs having a mechanism for adjusting both the height and angle of a backrest are disclosed in U.S. Pat. Nos. 1,927,491 to Gabb and 3,351,379 to Street. The patent to Gabb discloses a back rest slidably accommodated in a two-part clamp carried by a link pivotally connected to the seat. The clamp is operable by means of a hand screw member which maintains support both with respect to its vertical and angular adjustment by cooperation with an arcuate-shaped fixed abutment associated with the seat frame.

The patent to Street discloses a similar mechanism including an integral portion of a seat frame provided with inner and outer cylindrically convex regions complementary to concave faces of a block. To adjust both the angle and height of the backrest assembly in relation to the seat frame assembly, a hand piece is rotated to allow disengagement of the complementary serrated parts and permit angular movement together of the block and stem of a backrest in relation to a seat frame.

Another type of backrest adjustment mechanism is disclosed in U.S. Pat. No. 910,357 to Case. The patent to Case discloses a seat frame provided with a back bracket which is formed with a T-shaped slide channel that extends longitudinally backward and upward along the arc of a circle. The lower end of a backrest shank is curved downward and forward to fit and slide longitudinally in the channel of the back bracket. To limit upward movement of the shank in the channel, a spring-latch is provided in the shank which is adapted to normally enter and operate in a small longitudinal groove in the channel. To lock the shank at any desired position, a wedge block is located in a recess in one side of the concave face of the shank. The block is adapted to be forced toward the adjoining wall of the slide channel by a screw having a handle.

SUMMARY OF THE INVENTION

Briefly stated, the invention is directed to a chair, and more particularly, to an apparatus for adjusting the position of a backrest relative to a seat. The backrest includes an elongated stem with a curved lower portion, and a housing is adapted to slidably receive the curved portion of the stem. A latch mechanism is adapted to engage the stem to lock the backrest in a desired position, and an actuator member moves the latch mechanism between an engaged and disengaged position. Preferably, a spring is also provided which operably engages the stem to bias the stem in an upward direction. In operation, a user disengages the latch mechanism, moves the backrest stem in a curvilinear direction to a desired height and corresponding angular position, and reengages the latch mechanism to lock the backrest in said position.

Preferably, the latch mechanism comprises a rack on a lower portion of the stem and a pawl adapted to operably engage the rack. The rack has substantially the same curvature as the curved portion of the backrest and a plurality of teeth extending outwardly therefrom. The housing preferably has an aperture for slidably receiving the cur,ted portion of the stem and a cavity therein for slidably receiving the rack. In addition, the pawl is preferably actuated by a lever with one end accessible from outside side of the housing.

In one embodiment of the invention, the housing is adjustably attached to a seat support member. The housing is movable between a forward position adjacent the seat support member and a rearward position spaced apart from the seat support member, thus allowing further adjustment of the backrest.

The present invention provides significant advantages over other adjustable backrests. The curved lower portion of the backrest stem allows the position of the backrest to correspond with the natural posture of the back of a user in various reclined positions. Thus, the path of the backrest is defined by an arc with its center at the hip joints of a user sitting in the seat. In addition, the housing can be made as a sturdy guide for the backrest with an attractive encasement for concealing the backrest stem and latch mechanism. The stem and the rack slide easily in the housing, and in combination with the spring provide for easy adjustment of the backrest. Moreover, positioning the lever on the side of the housing provides a convenient and easily accessible means for actuating the pawl to allow the backrest to be adjusted while a user sits in the seat.

The present invention, together with further objects and advantages, will be best understood by reference to the following detailed description taken in conjunction with the accompanying drawings.

DETAILED DESCRIPTION OF THE PREFERRED EMBODIMENTS

Figure 2:
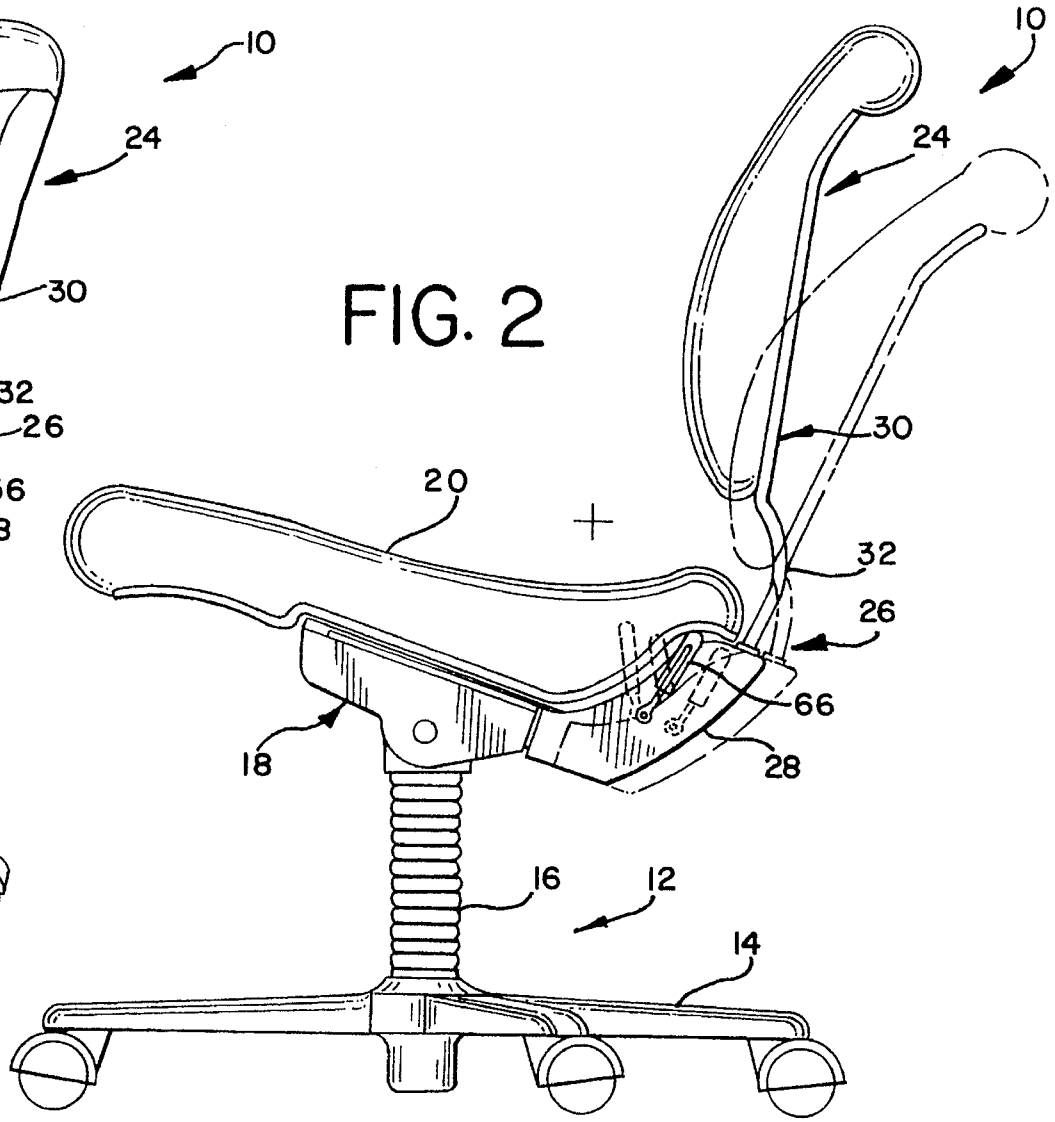
FIG. 2 is a side view of the chair showing the backrest in a raised and forward position and a lowered rearward position.
Figure 1:
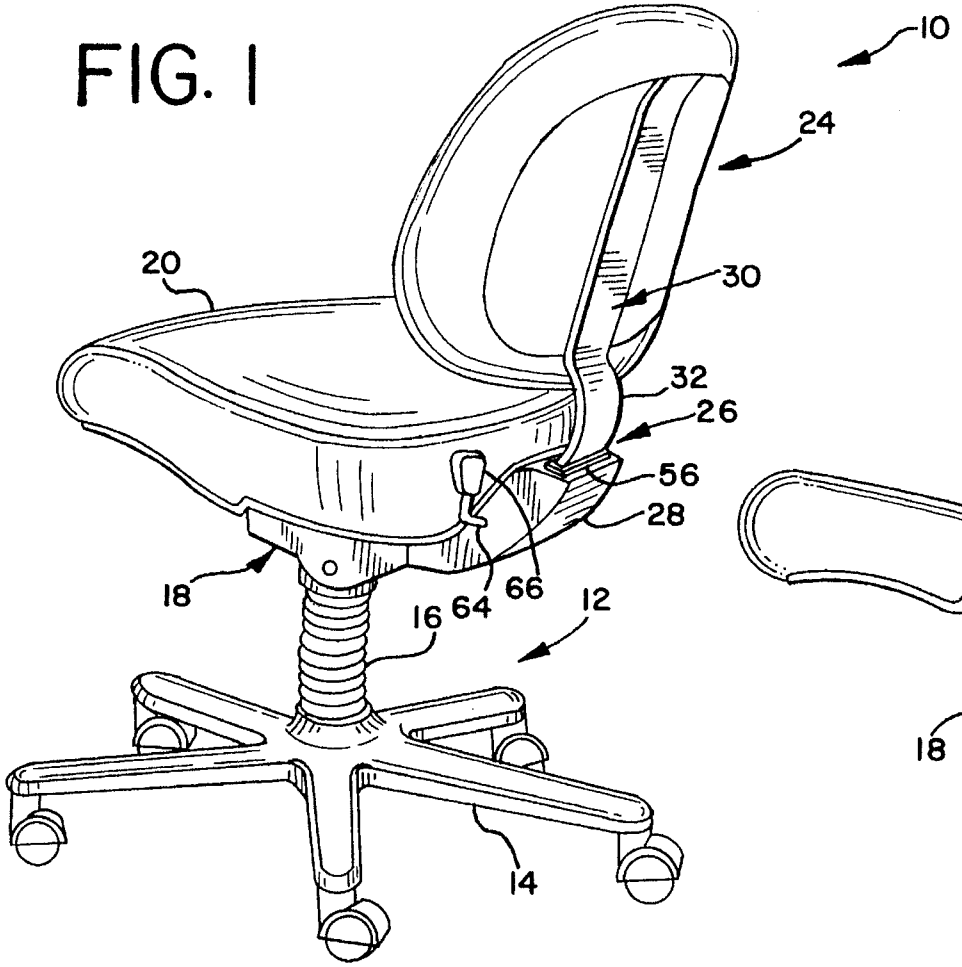
FIG. 1 is a perspective view of a chair with the backrest adjustment mechanism of the present invention.

Referring to the drawings, FIG. 1 shows a chair indicated generally at 10. The chair 10 includes a base structure 12 having a wheeled star-like base 14 and a vertically adjustable pedestal 16 extending upwardly therefrom. A stationary housing (not shown) is mounted to the pedestal 16, and a tilt housing 18 is mounted to the stationary housing for pivotal movement about a horizontal axis. The pivot axis of the tilt housing 18 can intersect the vertical axis of the pedestal 16, and a seat 20 is attached to the tilt housing 18. Typically, a spring (not shown) is provided for biasing the tilt housing 18 in an upward direction. A tilt control mechanism of this type is sold by Herman Miller, Inc. as P/N 238714 for use with its Ergon® line of office chairs. In addition, a pair of armrests (not shown) can extend upwardly from the tilt housing 18, and a backrest 24 is attached to the tilt housing by a backrest adjustment mechanism 26.

Although the seat 20 shown in FIG. 1 pivots about a horizontal axis above the pedestal 16, the backrest adjustment mechanism can be incorporated into any type of tilting chair or even a non-tilting chair. For example, the tilt housing can be rigidly mounted to the pedestal and the seat can be pivotally attached to a front end of the housing to provide a "knee-tilt" chair. A four-bar linkage or the like can also be employed to pivotally connect the seat to a stationary housing.

Referring now to FIGS. 1–7, the backrest adjustment mechanism 26 includes a housing 28 attached to the tilt housing 18 in a manner which will be described in more detail below. The backrest 24 includes an elongated, rectangular stem 30 having a curved lower portion 32 which is slidably received by the housing 28. The lower portion 32 preferably curves along an arc having a center 33 defined by a horizontal axis through the hip joints of a user sitting in the seat 20. This allows the position of the backrest 24 to correspond to the natural position of a user's back when the user is in a desired reclined position. Preferably, the backrest 24 can also tilt forward past a vertical plane to provide a comfortable support for a user leaning forward in a task-intensive work environment.

Figure 7:
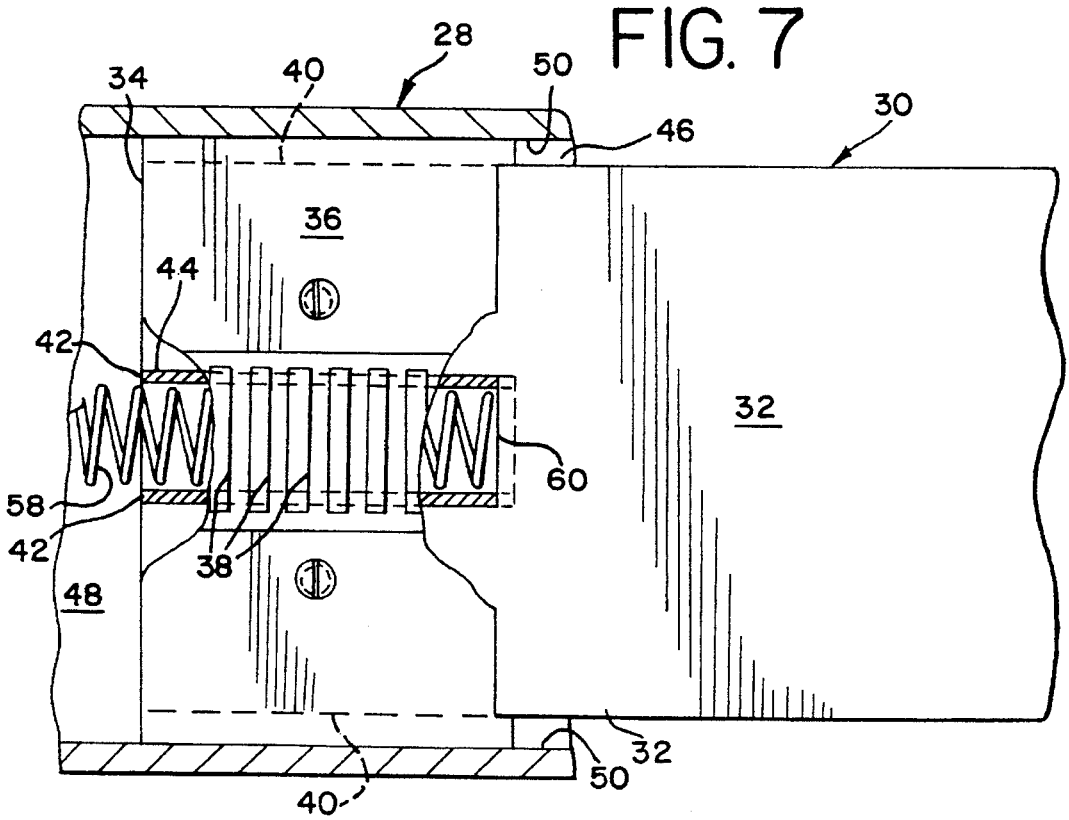
FIG. 7 is a top view of the stem and rack in FIG. 6.
Figure 9:
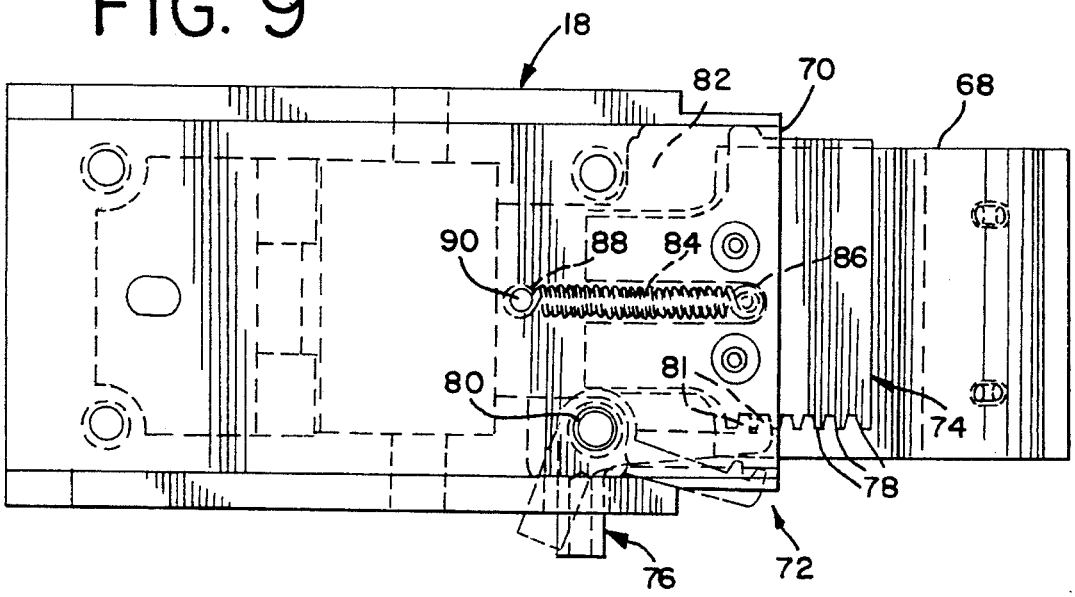
FIG. 9 is top view of the tilt housing in FIG. 8 shown with a portion of a top wall removed for clarity.
Figure 8:
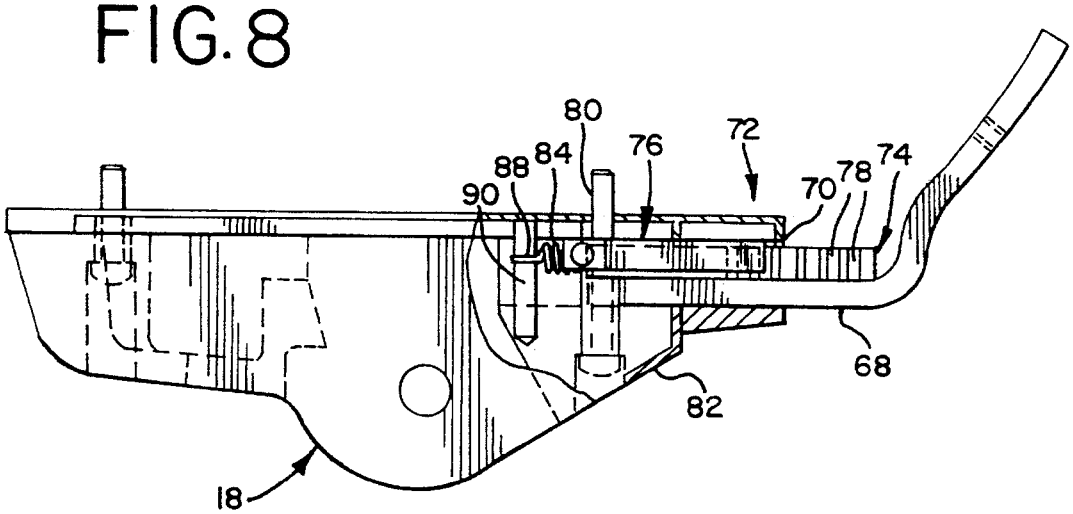
FIG. 8 is a side view of a tilt housing and a backrest support stem.

A rack 34 is rigidly attached to or integral with the lower end of the stem 30 and has the same curvature as the curved portion 32 of the backrest stem 30. The rack 34 includes a top plate 36 having a plurality of teeth 38 extending outwardly from the longitudinal center thereof. Preferably, the teeth 38 extend upwardly at an angle toward the top of the rack 34. The rack 34 also has side flanges 40 extending downwardly from the top plate 36, and spaced apart ribs 42 extending downwardly from the longitudinal center of the top plate 36. As best shown in FIG. 7, the ribs 42 fit within a longitudinal slot 44 formed in a lower end of the stem 30. The ribs 42 and slot 44 are preferably the same length as the top plate 36 and flanges 40 of the rack 34.

To guide the backrest 24 between a raised position (FIG. 3) and a lowered position (FIG. 4), the housing 28 has a cavity 46 configured to slidably receive the rack 34. The cavity 46 is defined by a bottom surface 48 having the same curvature as the rack 34, and side walls 50 which bear against the flanges 40 of the slidable rack 34. To limit the movement of the backrest 24, a top wall 52 and bottom wall 54 of the cavity 46 act as an upper and lower stop against which the rack 34 abuts. Further guidance of the backrest 24 is provided by a bushing 56 which is configured to slidably receive the curved portion 32 of the backrest stem.

Figure 3:
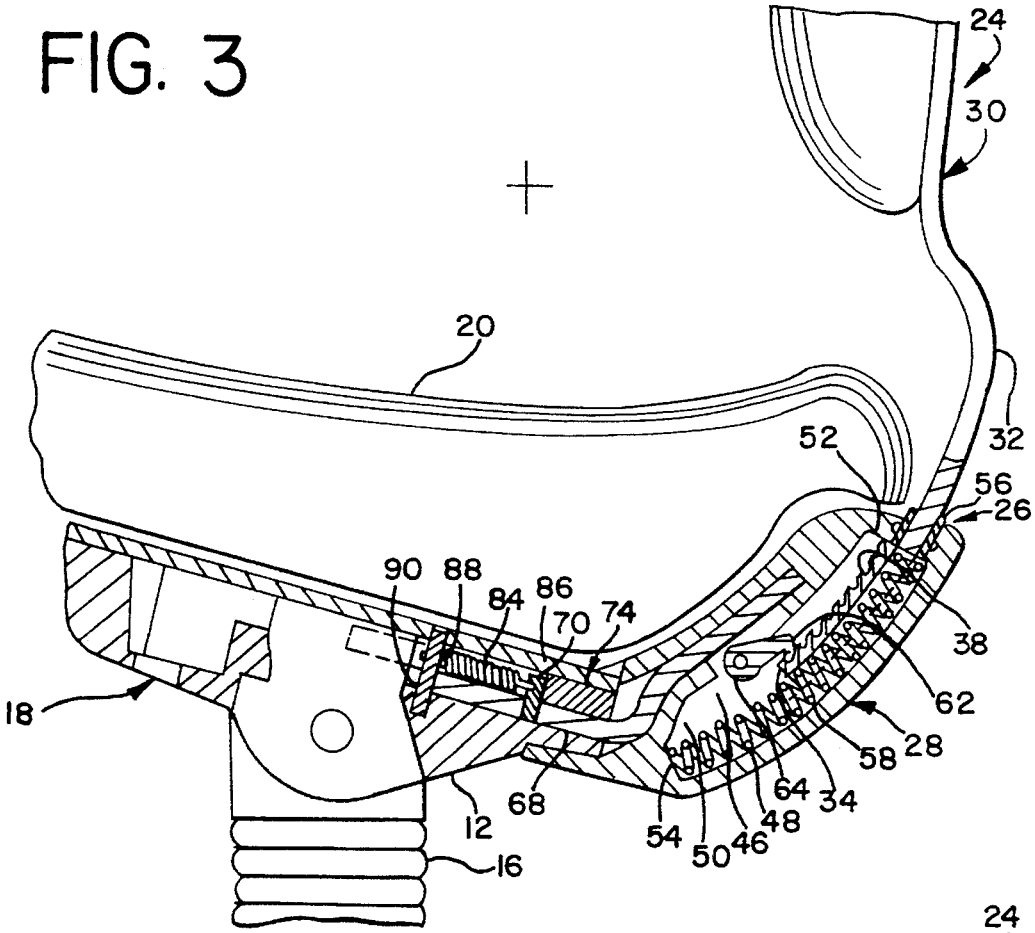
FIG. 3 is a side view of the chair, partially in cross-section, showing the backrest in a raised and forward position.

To assist a user in adjusting the backrest 24, a spring 58 is preferably provided to bias the backrest 24 in an upward direction. The spring 58 is positioned between the ribs 42 and curved top plate 36 of the rack and the bottom surface 48 of the housing cavity 46. One end of the spring 58 bears against the bottom wall 54 of the cavity 46, and another end of the spring 58 bears against an inner wall 60 of the slot 44 in the stem 30. Because a substantial portion of the spring 58 is constrained between the curved top plate 36 of the rack 34 and the curved bottom surface 48 of the cavity 46, the axis of the spring 58 conforms to the curvature of these surfaces. As shown in FIG. 3, the spring 58 retains this curvature even when a portion is not guided by the rack 34.

To releasably lock the backrest 24 in a desired position, a pawl 62 is positioned within the housing cavity 46 above the teeth 38 of the rack 34. The pawl 62 is rotatably attached to the housing 28 by a rod 64, and a handle 66 extends perpendicularly from an end of the rod 64 for actuating the pawl. Preferably, the pawl is biased toward the rack. Thus, the pawl 62 is rotatable between a disengaged and engaged position with the teeth 38 of the rack 34 to lock the backrest 24 in a desired position.

In operation, a user rotates the rod 64 in one direction by the handle 66 to disengage the pawl 62 from the rack 34. The user moves the backrest 24 and stem 30 in a curvilinear direction to a desired height and corresponding angular position. Finally, the user rotates the rod 64 in an opposite direction to reengage the pawl 62 with the rack 34 to lock the backrest 24 in the desired position.

Figure 4:
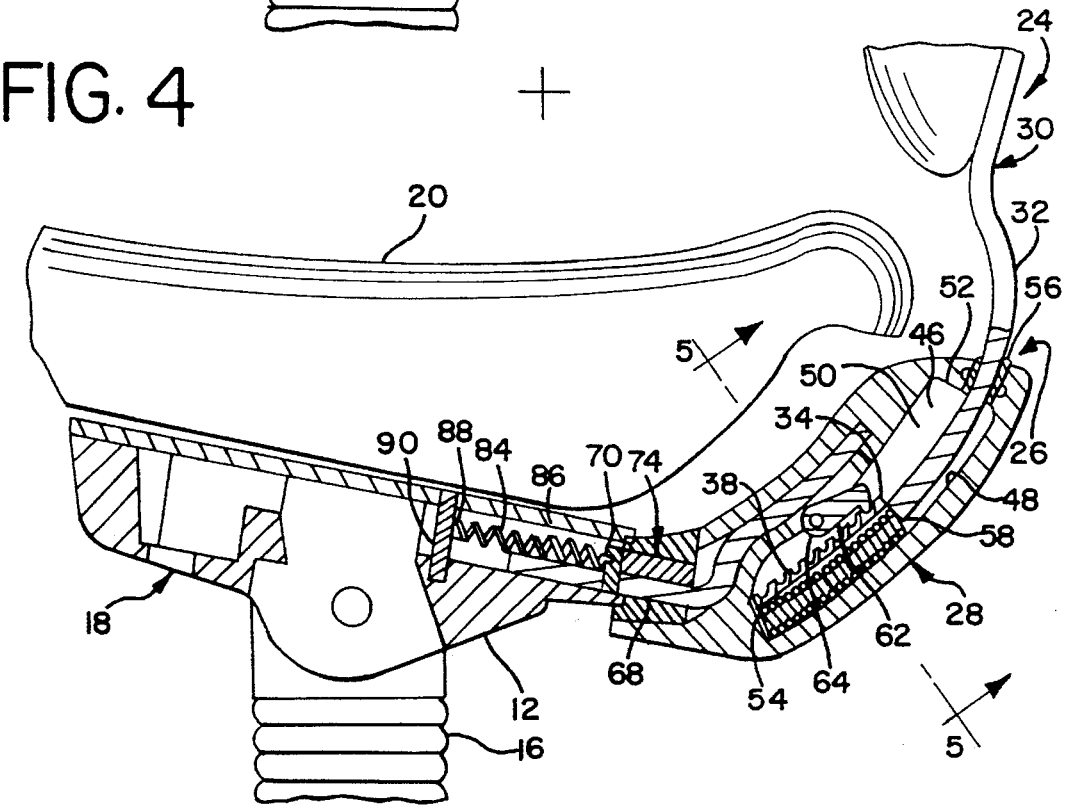
FIG. 4 is a side view of the chair, partially in cross-section, showing the backrest in a lowered and rearward position.
Figure 5:
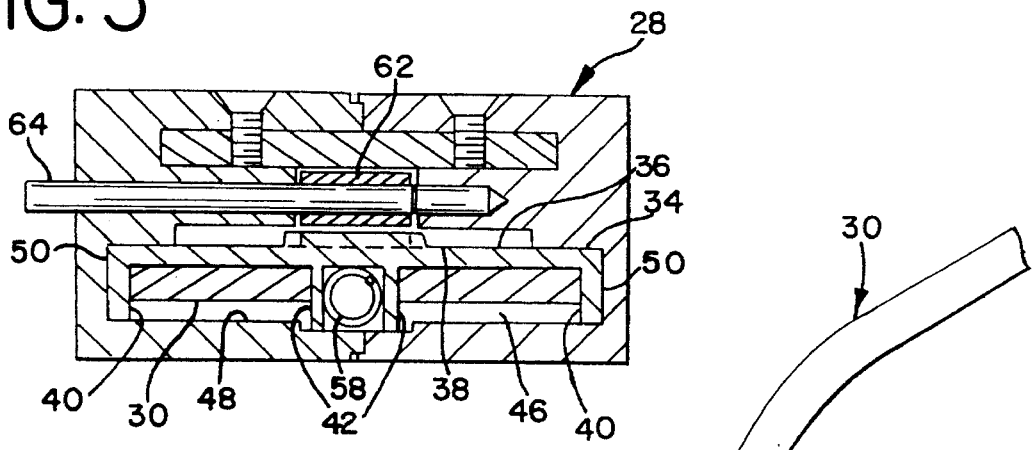
FIG. 5 is a cross-sectional view of the backrest adjustment mechanism taken along the line 5—5 in FIG. 4.
Figure 6:
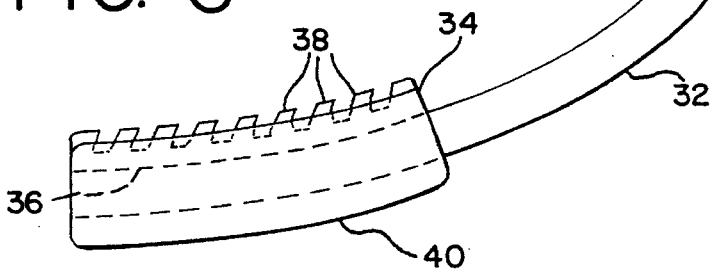
FIG. 6 is a side view of a backrest stem and a rack.

As shown in FIGS. 3–4, the housing 28 is movable in a linear direction between a forward position adjacent the tilt housing 18 (FIG. 3) and a rearward position spaced apart from the tilt housing 18 (FIG. 4). As best shown in FIGS. 3–4 and 8–9, the housing 28 is mounted to the tilt housing 18 by a support bracket 68 which extends outwardly from the housing 28 and into a slot 70 formed the tilt housing 18. Preferably, a latch mechanism 72 is provided for locking the housing 28 and backrest 24 in a desired rearward position. The latch mechanism 72 includes a rack 74 and a pawl 76 positioned within the tilt housing 18. The rack 74 is mounted to the support bracket 68 and also fits into the slot 70. The rack 74 also has a plurality of teeth 78 extending outwardly from a side edge thereof. The pawl 76 is rotatably attached to the tilt housing 18 by a pivot pin 80 which extends vertically upward from a bottom wall 82 of the tilt housing 18. Preferably, the pawl 76 has a pair of teeth 81 for engagement with two of the rack teeth 78.

Thus, an actuator member (not shown) is rotated in one direction to disengage the pawl 76 from the teeth 78 of the rack 74, the backrest 24 is moved forwardly or rearwardly to a desired position, and the actuator member is rotated in an opposite direction to reengage the pawl 76 with the rack 74. In addition, movement of the housing 28 and backrest 24 in a forward linear direction is aided by a spring 84. The spring 84 has an end 86 fastened to the rack 74 and an end 88 fastened to a vertical pin 90 which is mounted to the tilt housing 18.

The housing 28 of the adjustable backrest mechanism 26 can comprise various configurations in accordance with the present invention. For example, the tilt housing 18 can be stationary and the seat 20 can tilt relative to the housing 18. The backrest housing 28 can also be configured as a stationary or tiltable seat support housing rather than a separate unit attached to a seat support housing. Moreover, the seat and the backrest can be independently tiltable relative to each other.

Thus, an apparatus is provided for easily adjusting the backrest of a chair in a curvilinear direction and locking the backrest at a desired height and corresponding angular position. Also, the housing for the backrest adjustment mechanism is an attractive way to conceal the locking mechanism and provide guidance for the backrest stem.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. An apparatus for adjusting the position of a backrest relative to a chair seat, comprising:

said backrest including an elongated stem having a curved lower portion and a lower terminal end;

a spring operably engaging the stem at a point sufficiently distant from said terminal end such that the entirety of the spring is constrained by the stem when the backrest is in a lowered position, wherein said spring operates to bias said stem in an upward direction;

a stationary housing adapted to slidably receive the curved portion of the stem and guide the spring;

a latch mechanism adapted to lock the lower portion of the stem in a plurality of desired fixed positions within the housing such that the back of a user can rest against the backrest in said positions;

an actuator member adapted to move the latch mechanism between an engaged and disengaged position; and whereby disengagement of the latch mechanism allows the backrest stem to move in a curvilinear path to a desired height and corresponding angular position for the backrest, and whereupon reengagement of the latch mechanism locks the backrest stem in said position.

2. An apparatus for adjusting the position of a backrest relative to a chair seat, comprising:

said backrest including an elongated stem having a curved lower portion and a lower terminal end;

a spring operably engaging the stem distally of said terminal end to bias said stem in an upward direction;

a stationary housing adapted to slidably receive the curved portion of the stem and guide the spring;

a latch mechanism adapted to lock the lower portion of the stem in a plurality of desired fixed positions within the housing such that the back of a user can rest against the backrest in said positions, wherein the latch mechanism comprises a rack on the lower portion of the stem and a pawl adapted to operably engage the rack at selected locations including a proximal location and a distal location, a terminal portion of the spring engaging the stem at approximately said distal location;

an actuator member adapted to move the latch mechanism between an engaged and disengaged position; and whereby disengagement of the latch mechanism allows the backrest stem to move in a curvilinear path to a desired height and corresponding angular position for the backrest, and whereupon reengagement of the latch mechanism locks the backrest stem in said position.

3. The apparatus of claim 2 wherein the rack has substantially the same curvature as the curved portion of the backrest and the housing is configured to slidably receive the rack, and wherein the lower portion of the stem has a longitudinal slot for locating the spring therein, the spring engaging an uppermost wall of the slot.

4. An apparatus for adjusting the position of a backrest relative to a chain seat, comprising:

said backrest including an elongated stem having a curved lower portion and a lower terminal end, wherein the lower portion of the stem curves along an arc having a center defined by a horizontal line approximately through the hip joints of a user sitting in the chair seat;

a spring operably engaging the stem distally of said terminal end to bias said stem in an upward direction;

a stationary housing adapted to slidably receive the curved portion of the stem and guide the spring;

a latch mechanism adapted to lock the lower portion of the stem in a plurality of desired fixed positions within the housing such that the back of a user can rest against the backrest in said positions;

an actuator member adapted to move the latch mechanism between an engaged and disengaged position; and whereby disengagement of the latch mechanism allows the backrest stem to move in a curvilinear path to a desired height and corresponding angular position for the backrest, and whereupon reengagement of the latch mechanism locks the backrest stem in said position.

5. An apparatus for adjusting the position of a backrest relative to a chair seat, comprising:

said backrest including an elongated stem having a curved lower portion and a lower terminal end;

a spring operably engaging the stem distally of said terminal end to bias said stem in an upward direction;

a stationary housing adapted to slidably receive the curved portion of the stem and guide the spring;

a latch mechanism adapted to lock the lower portion of the stem in a plurality of desired fixed positions within the housing such that the back of a user can rest against the backrest in said positions, wherein the latch mechanism is enclosed by the housing and comprises a rack on the lower portion of the stem and a pawl rotatably attached to the housing by a rod;

an actuator member adapted to move the latch mechanism between an engaged and disengaged position, wherein the actuator member comprises a lever external to a side of the housing for rotating the pawl between engaged and disengaged positions with the rack; and whereby disengagement of the latch mechanism allows the backrest stem to move in a curvilinear path to a desired height and corresponding angular position for the backrest, and whereupon reengagement of the latch mechanism locks the backrest stem in said position.

6. An apparatus for adjusting the position of a backrest relative to a chair seat, comprising:

said backrest including an elongated stem having a curved lower portion and a lower terminal end;

a spring operably engaging the stem distally of said terminal end to bias said stem in an upward direction;

a housing adapted to slidably receive the curved portion of the stem and guide the spring, wherein the housing is adjustably attached to a rear portion of a seat support member, said housing being movable between a forward position adjacent the seat support member and a rearward position spaced apart from said seat support member, thus allowing fore and aft adjustment of the backrest;

a latch mechanism adapted to lock the lower portion of the stem in a plurality of desired fixed positions within the housing such that the back of a user can rest against the backrest in said positions;

an actuator member adapted to move the latch mechanism between an engaged and disengaged position; and whereby disengagement of the latch mechanism allows the backrest stem to move in a curvilinear path to a desired height and corresponding angular position for the backrest, and whereupon reengagement of the latch mechanism locks the backrest stem in said position.

7. A backrest adjustment apparatus for use with a chair having a base structure and a seat mounted on a seat support member, the apparatus comprising:

a backrest including an elongated stem having a curved lower portion;

a housing mounted to the seat support member and having an aperture for slidably receiving the curved portion of the stem and a cavity therein for accommodating said curved portion, the cavity having a greater width than the aperture;

a latch mechanism positioned within the housing cavity and adapted to engage the stem to lock the backrest in a plurality of desired positions such that the back of a user can rest against the backrest in said positions, the latch mechanism comprising a rack on the lower portion of the stem and a pawl adapted to operably engage the rack at selected locations, the rack having a width greater than the curved lower portion of the stem such that the rack slidably fits within the cavity and the stem slidably fits within the aperture, said width of the rack being greater than the width of the aperture in the housing to provide an uppermost stop for adjusting the backrest; and an actuator member accessible from outside the housing for moving the latch mechanism between an engaged and disengaged position;

whereby disengagement of the latch mechanism allows the backrest stem to move in a curvilinear path to a desired height and corresponding angular position for the backrest, and whereupon reengagement of the latch mechanism locks the backrest stem in said position.

8. The apparatus of claim 7 further comprising a spring positioned within the housing cavity and adapted to bias the stem in an upward direction.

9. The apparatus of claim 7 wherein the rack has substantially the same curvature as the curved portion of the backrest and the housing is configured to slidably receive the rack.

10. The apparatus of claim 9 wherein the pawl is rotatably attached to the housing by a rod and the actuator member comprises a lever external to a side of the housing for rotating the pawl between the engaged and disengaged positions with the rack.

11. The apparatus of claim 7 wherein the rack has substantially the same curvature as the curved portion of the backrest and the housing is configured to slidably receive the rack.

12. The apparatus of claim 7 wherein the housing is adjustably attached to a rear portion of the seat support member, said housing being movable between a forward position adjacent the seat support member and a rearward position spaced apart from said seat support member, thus providing fore and aft adjustment of the backrest.

13. The apparatus of claim 7 further comprising a spring positioned within the housing cavity and adapted to bias the stem and rack in an upward direction, said spring having an axis, wherein the axis of the spring and a bottom surface of the cavity have a curvature substantially the same as the curved portion of the backrest and rack.

14. A chair comprising:

a base structure;

a seat support member tiltably mounted to the base structure;

a backrest including an elongated stem having a curved lower portion; and a housing adjustably attached to a rear portion of the seat support member and adapted to slidably receive the curved portion of the stem, said housing being movable in a generally linear direction between a forward position adjacent the seat support member and a rearward position spaced apart from said seat support member;

whereby the backrest can tilt as a unit with the seat support member, move in a curvilinear path to a desired height and corresponding angular position, and move fore and aft to a desired overall position.

15. The apparatus of claim 14 wherein the housing has an aperture for slidably receiving the curved portion of the backrest stem and a cavity therein for accommodating said curved portion.

16. The apparatus of claim 15 further comprising a first latch mechanism positioned within the housing cavity and adapted to engage the backrest stem to lock the backrest in a desired position relative to the housing.

17. The apparatus of claim 16 wherein the seat support member is adapted to receive a bracket extending outwardly from the housing, and further comprising a second latch mechanism positioned within a cavity of the seat support member, said second latch mechanism adapted to engage the housing bracket to lock the housing in a desired position relative to seat support member.

18. A backrest adjustment apparatus for use with a chair having a base structure and a seat mounted on a seat support member, the apparatus comprising:

a backrest including an elongated stem having a curved lower portion;

a backrest support member adjustably attached to a rear portion of the seat support member and adapted to slidably receive the curved portion of the stem, said backrest support member being movable between a forward position adjacent the seat support member and a rearward position spaced apart from said seat support member, thus providing fore and aft adjustment of the backrest;

a latch mechanism adapted to lock the lower portion of the stem in a desired position; and an actuator member adapted to move the latch mechanism between an engaged and disengaged position;

whereby disengagement of the latch mechanism allows the backrest stem to move in a curvilinear path to a desired height and corresponding angular position for the backrest, and whereupon reengagement of the latch mechanism locks the backrest stem in said position.

19. The apparatus of claim 18 further comprising a spring adapted to bias the stem in an upward direction.

20. The apparatus of claim 18 wherein the latch mechanism comprises a rack on the lower portion of the stem and a pawl adapted to operably engage the rack.

21. The apparatus of claim 20 wherein the rack has substantially the same curvature as the curved portion of the backrest and the backrest support member is configured to slidably receive the rack.

22. The apparatus of claim 21 wherein the pawl is rotatably attached to the backrest support member by a rod and the actuator member comprises a lever external to a side of the backrest support member for rotating the pawl between the engaged and disengaged positions with the rack.

23. The apparatus of claim 18 wherein the lower portion of the stem curves along an arc having a center defined by a horizontal line approximately through the hip joints of a user sitting in the chair seat.

* * * * *